US009601251B2

(12) United States Patent
Grunwald

(10) Patent No.: US 9,601,251 B2
(45) Date of Patent: Mar. 21, 2017

(54) CORRECTION OF ANGLE ERRORS IN PERMANENT MAGNETS

(71) Applicant: Continental Teves AG & Co. oHG, Frankfurt (DE)

(72) Inventor: Frank Grunwald, Oberursel (DE)

(73) Assignee: Continental Teves AG & Co. oHG, Frankfurt (DE)

( * ) Notice: Subject to any disclaimer, the term of this patent is extended or adjusted under 35 U.S.C. 154(b) by 0 days.

(21) Appl. No.: 14/649,105

(22) PCT Filed: Dec. 9, 2013

(86) PCT No.: PCT/EP2013/075956

§ 371 (c)(1),
(2) Date: Jun. 2, 2015

(87) PCT Pub. No.: WO2014/087012

PCT Pub. Date: Jun. 12, 2014

(65) Prior Publication Data

US 2015/0332832 A1 Nov. 19, 2015

(30) Foreign Application Priority Data

Dec. 7, 2012 (DE) ..... 10 2012 023 897

(51) Int. Cl.
*H01F 7/02* (2006.01)
*H01F 41/02* (2006.01)
(Continued)

(52) U.S. Cl.
CPC ..... *H01F 7/0278* (2013.01); *B22F 3/02* (2013.01); *B22F 3/10* (2013.01); *B22F 3/12* (2013.01);
(Continued)

(58) Field of Classification Search
CPC ..... H01F 7/021; H01F 13/003; H01F 7/0278; H01F 41/0266; B22F 3/02; B22F 3/10; B22F 3/12; Y10T 29/49828
See application file for complete search history.

(56) References Cited

U.S. PATENT DOCUMENTS 2,897,417 A * 7/1959 MacDonough ..... H01F 13/003 335/284
4,536,230 A 8/1985 Landa
(Continued)

FOREIGN PATENT DOCUMENTS

CA 2426846 4/2003
CN 1466768 1/2004
(Continued)

OTHER PUBLICATIONS

German Search Report mailed Apr. 9, 2014 for German Application No. 10 2013 225 291.9, including partial translation.
(Continued)

*Primary Examiner* — Mohamad Musleh
(74) *Attorney, Agent, or Firm* — RatnerPrestia

(57) ABSTRACT

At least two partial magnets mechanically connected to each other. The length of each partial magnet runs in the main magnetisation direction of each partial magnet and/or in the main direction in which a partial magnet can be magnetised or in which its magnetisation is intended, and defines a first side and a second side as opposed regions at the ends of the partial magnet in respect of its length The at least two partial magnets are arranged in sequence in respect of their lengths and connected to each other. Deviations in the direction of the magnetisation and/or magnetisability of the first partial magnet deviating from the main magnetisation direction and/or main direction of magnetisability reduce and/or substantially compensate for the deviations in the direction of the magnetisation and/or magnetisability of the other or of
(Continued)

the adjacent partial magnet deviating from the main magnetisation direction and/or main direction of magnetisability.

16 Claims, 4 Drawing Sheets

(51) Int. Cl.

| | |
|---|---|
| ***B22F 3/02*** | (2006.01) |
| ***B22F 3/10*** | (2006.01) |
| ***B22F 3/12*** | (2006.01) |
| ***H01F 13/00*** | (2006.01) |

(52) U.S. Cl.
CPC ..... *H01F 7/021* (2013.01); *H01F 13/003* (2013.01); *H01F 41/0266* (2013.01); *Y10T 29/49828* (2015.01)

(56) References Cited

U.S. PATENT DOCUMENTS

| | | | | |
|---|---|---|---|---|
| 8,328,954 | B2 | 12/2012 | Nagata | |
| 2004/0158972 | A1 | 8/2004 | Creighton | |
| 2004/0189123 | A1* | 9/2004 | Nusser | F16C 32/0406 310/90.5 |
| 2005/0158972 | A1 | 7/2005 | Lin | |
| 2006/0158292 | A1 | 7/2006 | Ugai | |
| 2007/0090905 | A1* | 4/2007 | Van Glabeke | H01H 36/0013 335/205 |
| 2007/0245851 | A1 | 10/2007 | Sagawa | |
| 2010/0026432 | A1 | 2/2010 | Nagata | |
| 2010/0244608 | A1 | 9/2010 | Nakamura | |
| 2011/0241811 | A1 | 10/2011 | Ihara | |
| 2012/0194025 | A1 | 8/2012 | Fubuki | |

FOREIGN PATENT DOCUMENTS

| | | |
|---|---|---|
| DE | 975672 | 4/1962 |
| DE | 112008003493 | 10/2010 |
| WO | 03019587 | 3/2003 |

OTHER PUBLICATIONS

International Search Report mailed Mar. 5, 2014 for International Application No. PCT/EP2013/075956.

* cited by examiner

M_radial
M
M_axial
+
M_radial
M_axial

2
M_radial
4
3
M_radial
4
M_radial
M_axial 1
4
M_radial 1
4

CORRECTION OF ANGLE ERRORS IN PERMANENT MAGNETS

CROSS REFERENCE TO RELATED APPLICATIONS

This application is the U.S. National Phase Application of PCT International Application No. PCT/EP2013/075956, filed Dec. 9, 2013, which claims priority to German Patent Application No. DE 10 2012 023 897.5, filed Dec. 7, 2012, the contents of such applications being incorporated by reference.

FIELD OF THE INVENTION

The invention relates to a magnet arrangement and to a method for producing a magnet arrangement.

BACKGROUND OF THE INVENTION

Angle errors in the magnetization and/or orientation of the magnet material often occur during production of permanent magnets, in particular anisotropic permanent magnets. Keeping these angle errors as small as possible or avoiding them is relatively complex and can result in relatively high costs, depending on the degree of desired prism of the magnetization direction or orientation of the magnet material.

SUMMARY OF THE INVENTION

An aspect of invention is based on the problem of proposing a magnet arrangement and a method for producing a magnet arrangement which is relatively inexpensive and/or simple and/or enables a relatively high degree of precision of the magnetization and/or magnetizability with respect to a main magnetization direction and/or main direction of magnetizability of the entire magnet arrangement.

The wording substantially corrected is preferably understood to mean at least partially corrected and/or reduced and/or at least partially compensated for.

The term length of the part-magnet is alternatively preferably understood to mean a mechanical access of symmetry and/or a length and/or longitudinal direction of the body geometry of the solid geometry of the part-magnet.

The wording direction and/or main direction of magnetizability or magnetizable is expediently understood to mean the direction or main direction in which the magnet material or the magnet particles are oriented, in particular with respect to a preferred direction for the orientation thereof.

It is preferred that the total magnetic field of the magnet arrangement is formed by the orientation of the at least two part-magnets relative to one another in such a way that deviations in the magnetic fields generated by the part-magnets, based on magnetic fields which result exclusively owing to the magnetization along the magnetization direction, in interaction with the part-magnets are at least partially compensated for.

The magnet arrangement is preferably designed in such a way that the part-magnets are designed to be substantially anisotropic with respect to their magnet material or the magnetic particles or crystals.

It is expedient that the at least two part-magnets are produced using the same die, in particular in respect of their magnetization and/or magnetizability.

It is preferred that the part-magnets are each substantially cylindrical or in the form of a cylinder segment or hollow-cylindrical or right-parallelepidal or prism-shaped with a polygon, in particular an equilateral polygon, as base.

The magnet arrangement preferably comprises a plurality of part-magnets, of which in each case adjacent or adjoining part-magnets are mechanically connected to one another.

Preferably, each part-magnet is designed in such a way that, based on its main magnetization direction and/or main direction of its magnetizability, i.e. in particular based on its length, it has a substantially orthogonal magnetization and/or magnetizability with respect thereto, which is expediently understood as an orthogonal directional component of the magnetization or magnetizability, which in particular is referred to as the radial angle error of magnetization or magnetizability, wherein with respect to this orthogonal magnetization and/or magnetizability, one part-magnet is arranged relative to the adjoining other part-magnet so as to be rotated through an angle of between 140° and 220°, in particular through an angle of substantially 180°, based on the length or about the length or longitudinal axis of the part-magnets.

It is preferred that each part-magnet is designed in such a way that one side thereof has a greater degree of anisotropic and/or aligned orientation of the magnet particles arranged in this side and/or in the region of this side and/or of the corresponding magnet material than its other side, which in particular is referred to as a north-south error, wherein the side with the greater degree of anisotropic and/or aligned orientation of the magnet particles and/or the corresponding magnet material is defined as the strong pole of the part-magnet and, correspondingly, the side with the lower degree of anisotropic and/or aligned orientation of the magnet particles and/or of the corresponding magnet material is defined as the weak pole of the part-magnet, wherein the magnet arrangement is designed in such a way that adjacent part-magnets are oriented and arranged relative to one another in such a way that two weak poles and two strong poles of the two part-magnets adjoin one another and are connected to one another.

Expediently, the magnet arrangement is designed in such a way that the two abovementioned formations or arrangements of the part-magnet are combined so that both the radial angle error and the north-south error are compensated for or reduced or substantially corrected. Expediently, the part-magnets consist of sintered powder or plastic-injection-molded or plastic-bonded magnet material.

In particular, each part-magnet is designed in such a way that its first or second side has a higher degree of anisotropic or substantially parallel or aligned orientation of the magnet particles arranged on this side or in the region of this side than in the second or first side, i.e. in the other side. The side with the higher degree of anisotropic or aligned orientation of the magnet particles is particularly preferably referred to as the strong pole of the part-magnets and correspondingly the side with the lower degree of anisotropic or aligned orientation of the magnet particles is particularly preferably referred to as the weak pole of the part-magnet. This degree of orientation of the magnet particles is very particularly preferably understood to mean a measure of the anisotropy of the magnet particles with respect to their identical or aligned orientation.

It is preferred that the magnet arrangement is designed in such a way that the two strong poles or the two weak poles of the two part-magnets or of adjacent or in each case all of the adjacent part-magnets join one another. As a result, in particular the north-south error of the magnet arrangement can be avoided or reduced or substantially corrected.

Each part-magnet is in particular designed in such a way that, based on its length or length extent, it has a magnetization substantially orthogonal thereto or a radial magnetization or radial magnetizability or a radial angle error with respect to its magnetization or magnetizability.

It is preferred that, with respect to this radial magnetization or radial magnetizability or this radial angle error, one part-magnet is arranged relative to the adjoining other part-magnet in such a way as to be rotated through an angle of between 140° and 220° or through an angle of between 170° and 190° or through an angle of substantially 180°, in particular rotated about the length or longitudinal axis of the part-magnet as axis of rotation. As a result, in particular an angle error or a radial angle error of the magnet arrangement can be avoided or reduced.

It is preferred that the magnet arrangement is designed in such a way that both the two strong poles or the two weak poles of the part-magnets adjoin one another and that, also with respect to this/the radial magnetization or radial magnetizability or this radial angle error, one part-magnet is arranged relative to the adjoining other part-magnet in such a way that it is rotated through an angle of between 140° and 220° or through an angle of between 170° and 190° or through an angle of substantially 180°, in particular rotated about the length or longitudinal axis of the part-magnets as axis of rotation.

It is expedient that the part-magnets of the magnet arrangement are arranged substantially jointly centered one behind the other with respect to the central axis of said part-magnets in the longitudinal direction or in the direction of their length.

The at least two part-magnets of the magnet arrangement are preferably connected to one another by an adhesive or adhesive bonding.

The magnet arrangement is expediently bipolar, i.e. comprises two magnetic poles.

The method for producing the magnet arrangement is preferably embodied in such a way that the at least two part-magnets are produced in the same part-magnet production die.

The method is expediently configured in such a way that the fixing and/or cementing of the orientation of the magnet particles and/or of the magnetic material takes place by virtue of the fact that said magnetic material is pressed and/or sintered and/or baked and/or heat-treated and/or cured and/or cooled.

With respect to the method, it is preferred that once at least one first and one second part-magnet have been produced, the first and second part-magnets, as adjacent part-magnets in the magnet arrangement, are arranged one behind the other in respect of their orientation in the part-magnet production die and with respect to their longitudinal direction, wherein each part-magnet is designed in such a way that one side thereof has a greater degree of anisotropic and/or aligned orientation of the magnet particles arranged in this side and/or in the region of this side and/or the corresponding magnet material than its other side, wherein the side with the greater degree of anisotropic and/or aligned orientation of the magnet particles and/or of the corresponding magnet material is defined as the strong pole of the part-magnet and, correspondingly, the side with the lower degree of anisotropic and/or aligned orientation of the magnet particles and/or the corresponding magnetic material is defined as the weak pole of the part-magnet, wherein the magnet arrangement is designed in such a way that adjacent part-magnets are oriented and arranged relative to one another in such a way that two weak poles or two strong poles of the two part-magnets adjoin one another and are connected to one another, and/or each part-magnet is designed in such a way that, based on its main magnetization direction and/or main direction of its magnetizability, i.e. in particular based on its longitudinal direction, it has a substantially orthogonal magnetization and/or magnetizability with respect thereto, wherein with respect to this orthogonal magnetization and/or magnetizability, one part-magnet is arranged relative to the adjoining other part-magnet in such a way as to be rotated through an angle of between 140° and 220°, in particular through an angle of substantially 180°, based on the longitudinal direction of the part-magnets.

The magnet material, in particular in the form of a powder, is expediently compressed or pressed in form, in particular by the action of mechanical force, after the orientation of the magnet material or the magnet particles by an externally applied magnetic field. Then, such a pressed unmachined magnet part is preferably sintered or baked or heat-treated.

It is expedient that, once at least one first and one second part-magnet have been produced, the first and second part-magnets are arranged one behind the other with respect to their orientation in the part-magnet production die and with respect to their length or longitudinal axis, wherein the first or second part-magnet is turned in the longitudinal direction with respect to its two ends, with the result that its lower end is turned upside down and the other way round, for example, and/or wherein the first and/or second part-magnet are rotated and/or oriented relative to one another with respect to their longitudinal axis or length or substantially common longitudinal axis, wherein this relative rotation and/or orientation, wherein in particular the lateral surface is rotationally rotated or oriented, is performed through an angle of between 140° and 220° or through an angle of between 170° and 190° or through an angle of substantially 180°.

Then, the at least two part-magnets are expediently connected to one another.

Alternatively preferably, the at least two part-magnets are each produced by being compressed or pressed in form, whereafter the relative arrangement between at least the first and second part-magnets is performed, and then particularly preferably the at least two part-magnets are baked or sintered together in order to be permanently connected to one another.

It is preferred that the radial angle error and/or north-south error of each part-magnet arises and/or changes and/or is intensified or weakened during the course of production once orientation of the particles or the magnet material has already been performed by virtue of the respective part-magnet being mechanically deformed during pressing and/or sintering and/or baking and/or cooling.

It is expedient that the component of the main magnetization direction or the main direction of magnetizability of one or each part-magnet is greater than in other directions, in particular than in the orthogonal or radial direction, particularly preferably the ratio of the magnetization intensity or intensity of the magnetizability or the magnetic remanence or the magnetic remanence as a result of magnetization along the main magnetization direction, of the component in the main direction to the component in the orthogonal or radial direction is at least 95 to 5.

The magnet arrangement is expediently in the form of a permanent magnet.

The radial angle error is alternatively preferably also or instead referred to as an axial angle error.

The invention furthermore relates to the use of the magnet arrangement in motor vehicles, in particular in position sensor arrangements.

LIST OF REFERENCE SYMBOLS

1 Magnet arrangement
2 First part-magnet
3 Second part-magnet
4 Main magnetization direction or main direction in which the part-magnet is magnetizable
5 First side of part-magnet or strong pole
6 Second side of part-magnet or weak pole
7 Magnetic field of part-magnets or the two part-magnets
8 Die, in particular pressing die, or part-magnet production die
9 Orthogonal magnetization or magnetizability or component of the radial angle error
10 Punch
11 Field coils of the die
12 Length of the part-magnet or longitudinal direction of the part-magnet
13 Lines of force of the magnetization field or the magnetic field for the orientation of the magnet material or the magnet particles of a part-magnet

BRIEF DESCRIPTION OF DRAWINGS

The invention is best understood from the following detailed description when read in connection with the accompanying drawings. Included in the drawings is the following figures.

DETAILED DESCRIPTION OF THE PREFRERRED EMBODIMENTS

Figure 1:
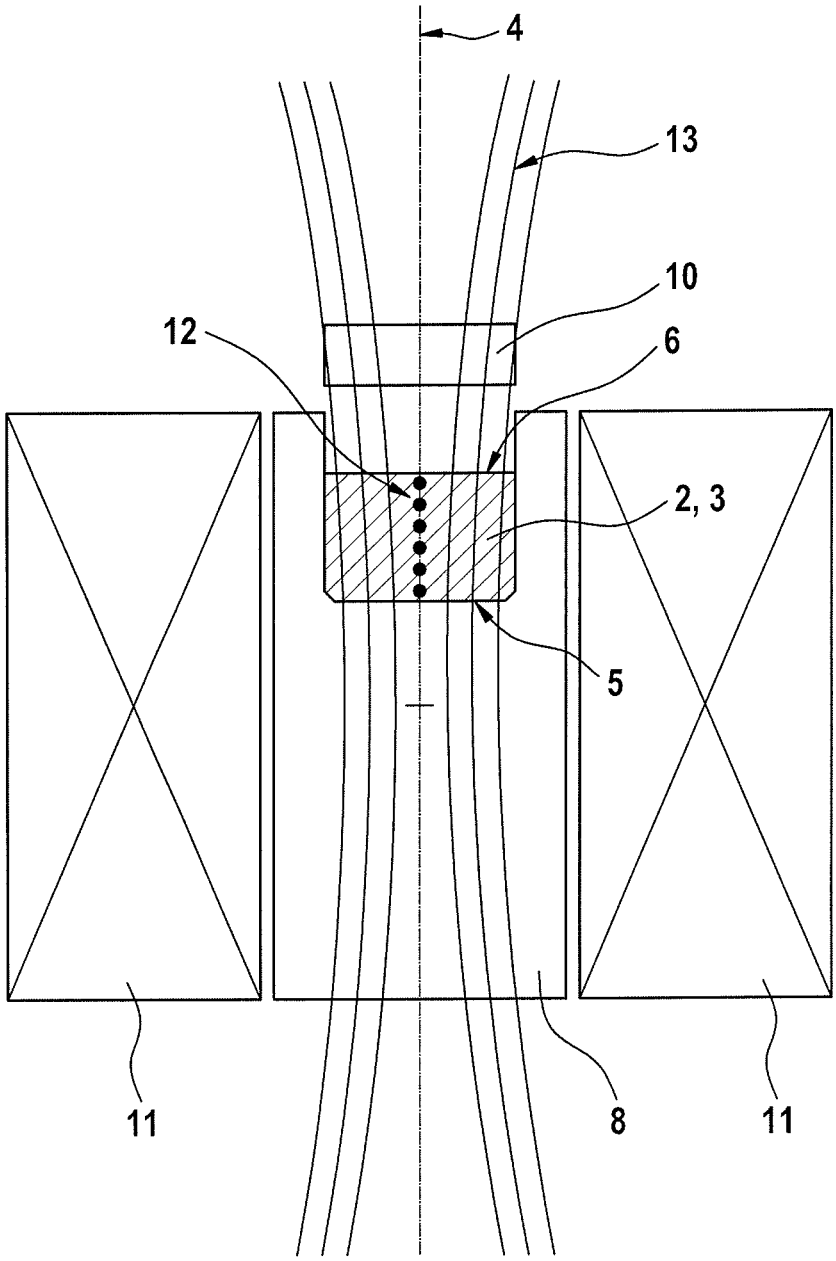
FIG. 1 shows the exemplary production of a part-magnet in a die in accordance with the prior art, in which a north-south error is produced.

Many applications for measured value acquisition are implemented using magnetic sensors. For this purpose, the actual sensor and a permanent magnet are used. The sensor detects the magnetic field emanating from the magnet, for example by means of a Hall effect sensor, the direction of the magnetic field, for example by means of an AMR sensor, or uses the magnetizing effect thereof, for example by means of a flux-gate sensor or an inductively acting sensor. Often, rotationally symmetric magnetic fields are required which are generated by permanent magnets in the form of round plates or rings or cylinders. These rings or round plates or cylinders are magnetized axially thereto, i.e. in their longitudinal direction. It is desirable or necessary for the mechanical and the magnetic axis of symmetry or longitudinal or main direction to be congruent or aligned. Unfortunately, it is often not possible for manufacturing-related reasons for the magnetic and mechanical axis of symmetry to be aligned or identical, as is illustrated by way of example using FIG. 2.

There is an angle, the so-called radial angle error of the magnet or part-magnets 2, 3, between the two axes. Depending on the production method, a wide distribution of the angle errors occurring in the case of different or a plurality of magnets can arise. This is the case when the magnets are pressed into large blocks. When the magnets are pressed axially individually, the radial angle error occurring is approximately the same for all magnets. As a further error, the so-called north-south error often occurs in the case of magnets, but in this north-south error it is illustrated by way of example in FIG. 1. The north-south error is concerned with the fact that the thickness of the poles of a magnetic is often different and, as a result, the separation line between the north and south pole of the magnet is not precisely in the geometric center of the magnet. Both errors, namely the radial angle error (see FIG. 2) and the north-south error (see FIG. 1), are based on the lack of orientation, i.e. not precisely parallel orientation, of the magnet particles during pressing of the magnet blanks. In order to achieve as high remanences as possible, a strong magnetic field is applied during pressing of the magnet powder in order to orientate the particles of the powder. This magnetic field is not, homogeneous, however, but is slightly divergent. This results in a strong pole on the lower side and a weaker, i.e. weak pole on the upper side (see FIG. 1). This is the mentioned north-south error. The radial angle error is likewise based on an erroneous orientation of the particles of the magnet powder. The cause for this is an angle between the axis of symmetry of the magnet die and the orienting magnetic field (FIG. 2). Both errors are fixed in the magnet after sintering and also do not need to be compensated for by special magnetization.

An exemplary description of an exemplary embodiment with integrated variants follows:

In this regard, the magnet is replaced, for example, by two magnets, which have half the height. The second magnet is "upended" for this purpose so that two identical poles, with respect to their orientation in the part-magnet production die, touch one another (either the weaker or the stronger poles). As a result, the north-south error is compensated for, as is illustrated by way of example in FIG. 3. In order to compensate for the radial or axial angle error, as illustrated in FIG. 4, the upper magnet still needs to be oriented or rotated in such a way that the undesired radial components of the magnetization point in the opposite direction. As a result, these components are weakened and are practically canceled out in the "far field".

Exemplary Advantages:

An exemplary method proposed here or the exemplary magnet arrangement makes it possible to drastically reduce the undesired angle error or radial angle error or the north-south error. Explanation by way of example: during axial pressing of magnets, the zone in which the magnet is pressed is not in the center of the coil, which orientates the magnet powder prior to pressing. This means that the strong pole of the magnet is always stronger than the weak pole of the magnet. Since the magnetization of the magnets is lost during sintering thereof, in the case of later remagnetization an identical number of magnets with a strong south pole and a strong north pole is provided, in particular when the magnetization orientation for some part-magnets is opposite that of the other part-magnets.

Owing to the exemplary method proposed here, all of the part-magnets and magnet arrangements are identical, by way of example. The north-south error in this case no longer occurs or is substantially reduced. An oriented installation with respect to the strong and weak poles of the magnet, as would otherwise possibly be required, is not necessary.

Figure 2:
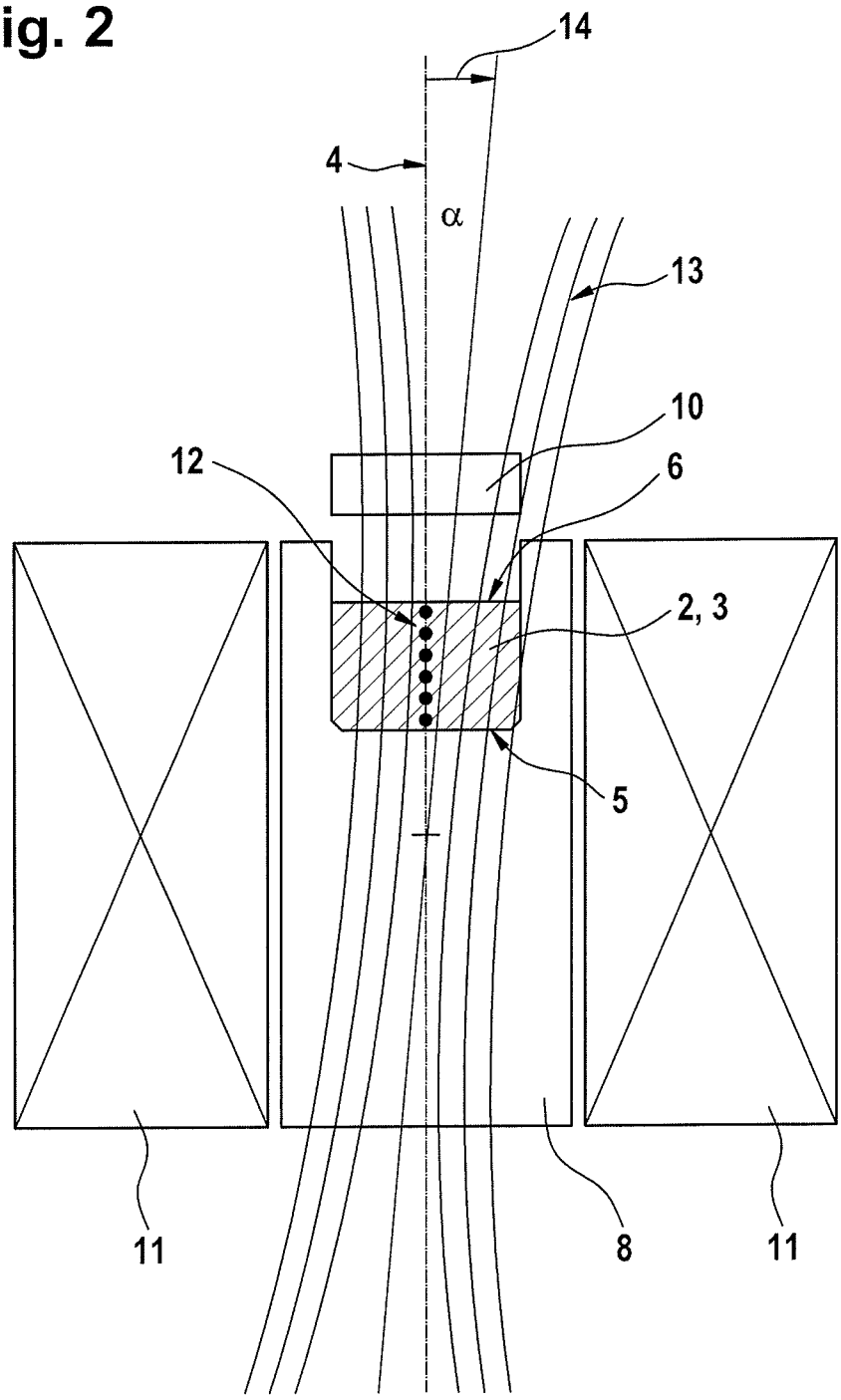
FIG. 2 shows the occurrence of an angle error or a magnetization or orientation deviation of the magnetic material in the event of such an exemplary production, in addition to a north-south error.

The exemplary production of a part-magnet 2, 3 whose material is arranged in the die 8 in a corresponding cavity is illustrated in FIG. 1. Field coils 11 generate a magnetic field for the orientation of the magnet material in the part-magnet 2, 3 with the lines of force 13, which have a main direction 4 of magnetizability, along which the length 12 of the part-magnet, illustrated by dotted lines, is oriented, which length forms a geometric axis of symmetry of the body of the part-magnet 2, 3. Once the magnetic field 13 for orienting the magnet particles has been applied, the material of the part-magnet 2, 3 is pressed by means of a punch 10. Since the magnetic field 13 has a lesser field density in the upper region 6 of the part-magnet than in the lower region 5, a strong pole 5 of the part-magnet is formed in the lower region and a weak pole 6 is formed in the upper region. The development of these two poles 5, 6 of different strength, brought about by the different degree of orientation of the magnet material at the two ends 5 and 6, is referred to as north-south error.

During the production of a part-magnet 2, 3 illustrated by way of example in FIG. 2, in addition a radial angle error is produced, owing to a radial or orthogonal component of the magnetic field 13, which is generated by means of the field coils 11 for the orientation of the magnetic particles or the magnet material. Owing to this orthogonal or radial component 14, a magnetic field is produced which has an angular offset a with respect to the main direction of magnetization and with respect to the geometric axis of symmetry of the part-magnets 2, 3 and with respect to the length or longitudinal axis 12 thereof. Once the magnet particles have been oriented, the material of the part-magnet 2, 3 is likewise compressed in the die 8 by means of the punch 10. The part-magnet 2, 3 now has a north-south error owing to the different field density on its upper side and lower side 6, 5 and a radial angle error.

Figure 3C:
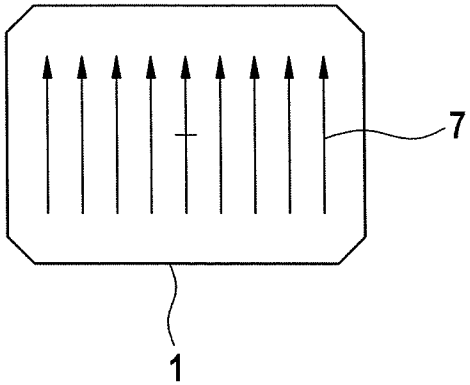
FIGS. 3*a*-3*c* show an exemplary magnet arrangement, with a compensated or reduced north-south error.
Figure 3B:
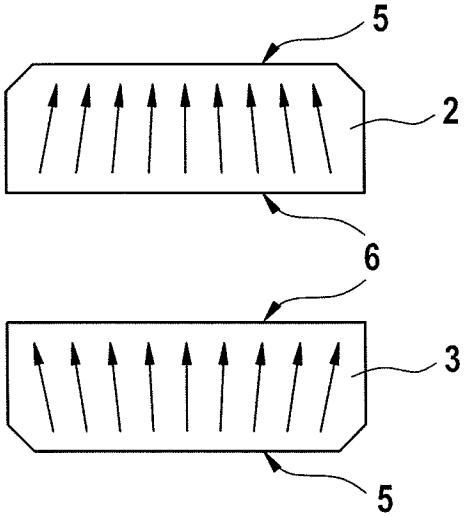
Figure 3A:
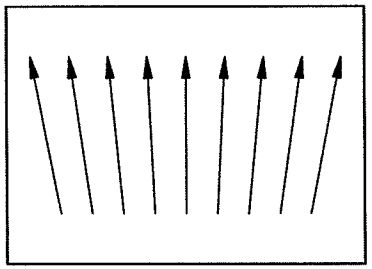

With reference to FIGS. 3*a*) to *c*), it will now be explained, by way of example, how, in the case of a magnet arrangement comprising a first and a second part-magnet, the north-south error is substantially compensated for, and at least substantially reduced.

FIG. 3*a*) shows a magnet with a north-south error, wherein the magnetization lines of force are illustrated in FIGS. 3*a*) to *c*) in each case by the arrows. Two part-magnets 2, 3 are now depicted in FIG. 3*b*), said part-magnets having been produced using the same die and in each case having a strong pole 5 and a weak pole 6 with respect to their magnetizability. The two part-magnets are now joined axially to one another with their weak poles 6, by way of example, and connected mechanically to one another, as illustrated in FIG. 3*c*), and magnetized jointly. The resultant magnetic field 7 of the magnet arrangement 1 does not have any substantially north-south error anymore, at least when detected at a defined minimum spacing.

Figures 4A, 4B, 4C, 4D:
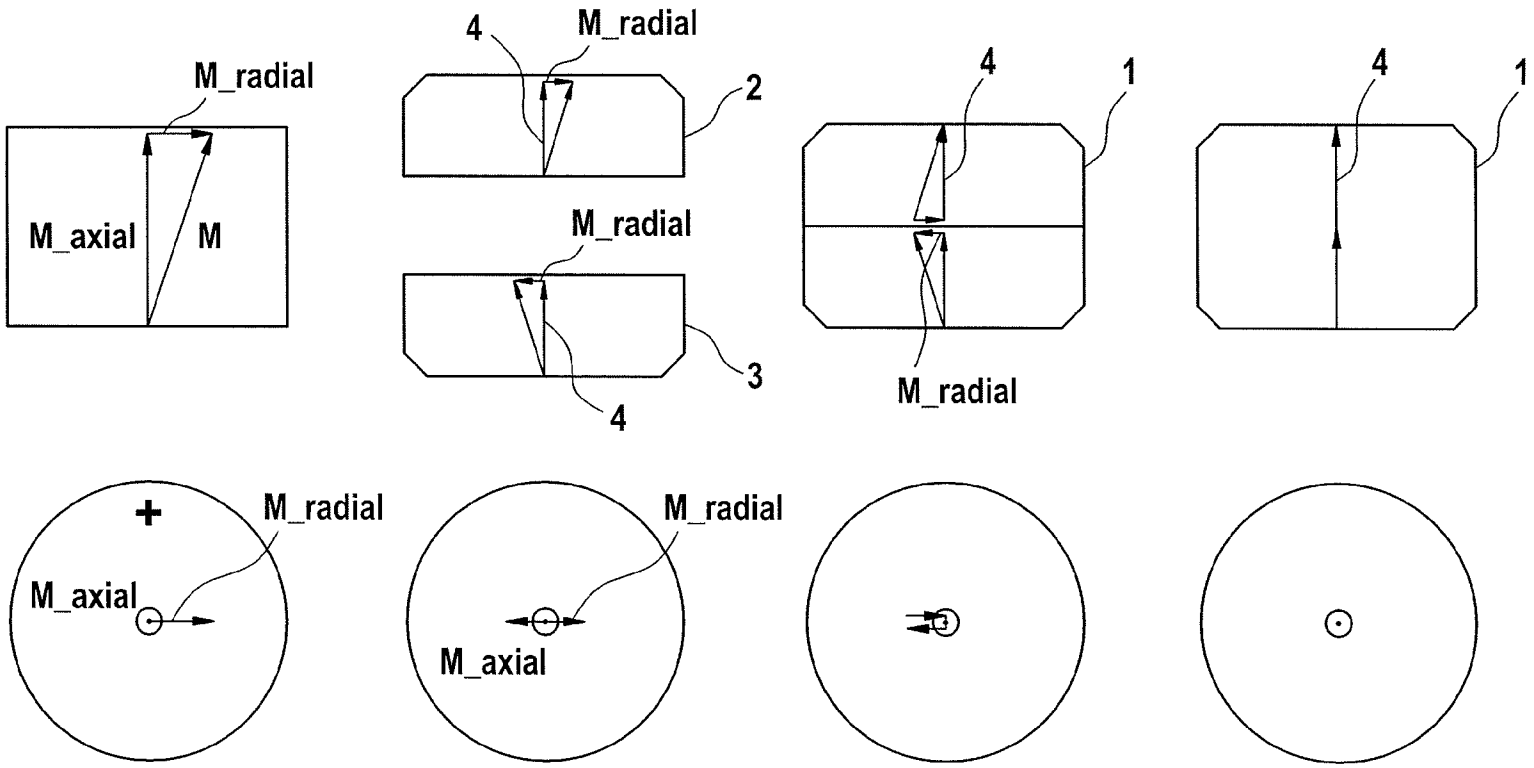
FIGS. 4*a*-4*d* show an exemplary magnet arrangement, with a compensated or reduced orthogonal or radial or axial angle error.

FIGS. 4*a*) to *d*) show, by way of example, how the radial angle error in a magnet arrangement consisting of two part-magnets 2, 3 is compensated for or at least substantially reduced. In this case, in each case a side view is illustrated at the top and a plan view is illustrated at the bottom of the magnet or the magnet arrangement. In addition to the dominant component of the desired main direction M_axial of magnetizability, the magnet in FIG. 4*a*) has a radial component M_radial of magnetizability, as a result of which the total direction of magnetizability M is developed, which now has a radial angle error. The orientation direction of the magnet particles is thus not parallel to the geometric axis of symmetry or longitudinal axis or length of the magnet. Two part-magnets 2 and 3 which have been produced in the same die and each have an angle error of the same degree or developed in the same way, in each case with the radial component of magnetizability M_radial, are illustrated in FIG. 4*b*). These two part-magnets 2 and 3 are now arranged one behind the other and oriented relative to one another in such a way that the radial component of one magnet 2 is rotated through 180° with respect to the radial component of the other magnet 3 about the longitudinal axis or main direction of magnetizability 4. As is illustrated by way of example in FIG. 4*c*), the two part-magnets are then connected mechanically to one another and, as described with reference to FIG. 4*b*), oriented relative to one another and form a magnet arrangement 1. FIG. 4*d*) illustrates by way of example how, at least at a minimum distance from the magnet arrangement 1, the radial angle error is now compensated for or at least considerably reduced.

The invention claimed is:

1. A magnet arrangement, comprising:

at least two part-magnets, which are mechanically connected to one another, wherein the length of each part-magnet ends along the main magnetization direction of each part-magnet and/or the main magnetization direction in which a part-magnet is magnetizable or the magnetization thereof is provided, and a first side and a second side, defined as opposite regions at the ends of the part-magnet with respect to the length thereof, and wherein the at least two part-magnets are arranged one behind the other with respect to their length and are connected to one another, wherein the at least two part-magnets are oriented relative to one another with respect to their magnetization and/or magnetizability, in that north-south deviations in respect of a thickness of poles of one part-magnet produce and/or substantially correct north-south deviations in respect of a thickness of poles of the other or adjacent part-magnet, based on the magnetization and/or magnetizability of the entire magnet arrangement.

2. The magnet arrangement as claimed in claim 1, wherein said magnet arrangement is designed in such a way that a total magnetic field of the magnet arrangement is formed by the orientation of the at least two part-magnets relative to one another in such a way that deviations in the magnetic fields generated by the part-magnets, based on magnetic fields which result exclusively owing to the magnetization along the magnetization direction, in interaction with the part-magnets are at least partially compensated for.

3. The magnet arrangement as claimed in claim 1, wherein the part-magnets are formed so as to be substantially anisotropic in respect of their magnet material.

4. The magnet arrangement as claimed in claim 1, wherein the at least two part-magnets are produced using the same die, in respect of their magnetization and/or magnetizability.

5. The magnet arrangement as claimed in claim 1, wherein the part-magnets are each substantially cylindrical or in the form of a cylinder segment or hollow-cylindrical or right-parallelepidal or prism-shaped with a polygon as base.

6. The magnet arrangement as claimed in claim 1, wherein each part-magnet is designed in such a way that, based on its main magnetization direction and/or main direction of its magnetizability, it has a substantially orthogonal magnetization and/or magnetizability with respect thereto, wherein with respect to this orthogonal magnetization and/or magnetizability, one part-magnet is arranged relative to the adjoining other part-magnet so as to be rotated through an angle of between 140° and 220° , based on the length of the part-magnets.

7. A magnet arrangement, comprising:

at least two part-magnets, which are mechanically connected to one another, wherein the length of each part-magnet ends along the main magnetization direction of each part-magnet and/or the main magnetization direction in which a part-magnet is magnetizable or the magnetization thereof is provided, and a first side and a second side, defined as opposite regions at the ends of the part-magnet with respect to the length thereof, and wherein the at least two part-magnets are arranged one behind the other with respect to their length and are connected to one another, wherein the at least two part-magnets are oriented relative to one another with respect to their magnetization and/or magnetizability, in that deviations in respect of the direction of the magnetization and/or magnetizability of one part-magnet from the main magnetization direction and/or main direction of magnetizability produce and/or substantially correct the deviations in respect of the direction of the magnetization and/or magnetizability of the other or adjacent part-magnet from the main magnetization direction and/or main direction of magnetizability, based on the magnetization and/or magnetizability of the entire magnet arrangement, and wherein each part-magnet is designed in such a way that one side thereof has a greater degree of anisotropic and/or aligned orientation of the magnet particles arranged in this side and/or in the region of this side and/or of the corresponding magnet material than its other side, wherein the side with the greater degree of anisotropic and/or aligned orientation of the magnet particles and/or the corresponding magnet material is defined as the strong pole of the part-magnet and, correspondingly, the side with the lower degree of anisotropic and/or aligned orientation of the magnet particles and/or of the corresponding magnet material is defined as the weak pole of the part-magnet, wherein the magnet arrangement is designed in such a way that adjacent part-magnets are oriented and arranged relative to one another in such a way that two weak poles and two strong poles of the two part-magnets adjoin one another and are connected to one another.

8. A method for producing a magnet arrangement, wherein the magnet arrangement is assembled from at least two part-magnets, which are mechanically connected to one another, wherein during or in the case of or prior to the production of the part-magnets, the magnet particles and/or the magnetic material are substantially or principally oriented in a longitudinal direction of the part-magnet, as main magnetization direction and/or main direction of magnetizability, whereafter the orientation of the magnet particles and/or the magnetic material is fixed, wherein the at least two part-magnets are arranged relative to one another in respect of their magnetization and/or magnetizability in such a way that north-south deviations in respect of a thickness of poles of one part-magnet reduce and/or substantially correct north-south deviations in respect of a thickness of poles of the other or adjacent part-magnet, based on the magnetization and/or magnetizability of the entire magnet arrangement.

9. The method as claimed in claim 8, wherein the at least two part-magnets are produced in the same part-magnet production die.

10. The method as claimed in claim 8, wherein the fixing and/or cementing of the orientation of the magnet particles and/or of the magnetic material takes place by virtue of the fact that said magnetic material is pressed and/or sintered and/or baked and/or heat-treated and/or cured and/or cooled.

11. A method for producing a magnet arrangement, wherein the magnet arrangement is assembled from at least two part-magnets, which are mechanically connected to one another, wherein during or in the case of or prior to the production of the part-magnets, the magnet particles and/or the magnetic material are substantially or principally oriented in a longitudinal direction of the part-magnet, as main magnetization direction and/or main direction of magnetizability, whereafter the orientation of the magnet particles and/or the magnetic material is fixed, wherein the at least two part-magnets are arranged relative to one another in respect of their magnetization and/or magnetizability in such a way that deviations in respect of the direction of the magnetization and/or magnetizability of one part-magnet from the main magnetization direction and/or main direction of magnetizability reduce and/or substantially correct the deviations in respect of direction of magnetization and/or magnetizability of the other or adjacent part-magnet from the main magnetization direction and/or main direction of magnetizability, based on the magnetization and/or magnetizability of the entire magnet arrangement, and wherein once at least one first and one second part-magnet have been produced, the first and second part-magnets, as adjacent part-magnets in the magnet arrangement, are arranged one behind the other in respect of their orientation in the part-magnet production die and with respect to their longitudinal direction, wherein each part-magnet is designed in such a way that one side thereof has a greater degree of anisotropic and/or aligned orientation of the magnet particles arranged in this side and/or in the region of this side and/or the corresponding magnet material than its other side, wherein the side with the greater degree of anisotropic and/or aligned orientation of the magnet particles and/or of the corresponding magnet material is defined as the strong pole of the part-magnet and, correspondingly, the side with the lower degree of anisotropic and/or aligned orientation of the magnet particles and/or the corresponding magnetic material is defined as the weak pole of the part-magnet, wherein the magnet arrangement is designed in such a way that adjacent part-magnets are oriented and arranged relative to one another in such a way that two weak poles or two strong poles of the two part-magnets adjoin one another and are connected to one another, and/or each part-magnet is designed in such a way that, based on its main magnetization direction and/or main direction of its magnetizability, i.e. in particular based on its longitudinal direction, it has a substantially orthogonal magnetization and/or magnetizability with respect thereto, wherein with respect to this orthogonal magnetization and/or magnetizability, one part-magnet is arranged relative to the adjoining other part-magnet in such a way as to be rotated through an angle of between 140° and 220° based on the longitudinal direction of the part-magnets.

12. The magnet arrangement as claimed in claim 2, wherein the part-magnets are formed so as to be substantially anisotropic in respect of their magnet material.

13. The magnet arrangement as claimed in claim 1, wherein the part-magnets are each substantially cylindrical or in the form of a cylinder segment or hollow-cylindrical or right-parallelepidal or prism-shaped with an equilateral polygon as base.

14. The magnet arrangement as claimed in claim 1, wherein each part-magnet is designed in such a way that, based on its main magnetization direction and/or main direction of its magnetizability, i.e. in particular based on its length, it has a substantially orthogonal magnetization and/or magnetizability with respect thereto, wherein with respect to this orthogonal magnetization and/or magnetizability, one part-magnet (2) is arranged relative to the adjoining other part-magnet so as to be rotated through an angle of substantially 180° based on the length of the part-magnets (2, 3).

15. The method as claimed in claim 9, wherein the fixing and/or cementing of the orientation of the magnet particles and/or of the magnetic material takes place by virtue of the fact that said magnetic material is pressed and/or sintered and/or baked and/or heat-treated and/or cured and/or cooled.

16. The method as claimed in claim 11, wherein angle of between 140° and 220° is an angle of substantially 180°.

* * * * *